US005768652A

United States Patent [19]

Janssens et al.

[11] Patent Number: 5,768,652

[45] Date of Patent: Jun. 16, 1998

[54] METHOD OF CONTROLLING AN ELECTROPHOTOGRAPHIC IMAGING PROCESS

[75] Inventors: Robert Janssens, Geel; Luc Van Goethem, Sint-Gillis-Waas; Willem Waterschoot, Belsele; Chris Pattyn, Ypres, all of Belgium

[73] Assignee: Agfa-Gevaert, Mortsel, Belgium

[21] Appl. No.: 736,014

[22] Filed: Oct. 22, 1996

Related U.S. Application Data

[60] Provisional application No. 60/009,573, Jan. 3, 1996.

[30] Foreign Application Priority Data

Nov. 16, 1995 [EP] European Pat. Off. ..... 95203141

[51] Int. Cl.[6] ..... G03G 15/06

[52] U.S. Cl. ..... 399/14; 399/44; 399/53; 399/254; 358/300

[58] Field of Search ..... 399/14, 29, 43, 399/44, 53, 254; 358/300

[56] References Cited

U.S. PATENT DOCUMENTS

| | | | |
|---|---|---|---|
| 4,947,473 | 8/1990 | Kinashi | 399/53 |
| 5,202,769 | 4/1993 | Suzuki | 358/300 |
| 5,204,698 | 4/1993 | LeSueur et al. | 347/140 |
| 5,448,277 | 9/1995 | Long | 399/14 X |
| 5,508,786 | 4/1996 | Ogiri et al. | 399/43 |

FOREIGN PATENT DOCUMENTS

| | | |
|---|---|---|
| 0584744 | 3/1994 | European Pat. Off. . |
| 54-084741 | 7/1979 | Japan . |
| 59-116768 | 7/1984 | Japan . |
| 61-158354 | 7/1986 | Japan . |
| 63-008767 | 1/1988 | Japan . |
| 1-319760 | 12/1989 | Japan . |

*Primary Examiner*—Nestor R. Ramirez
*Attorney, Agent, or Firm*—Baker & Botts, L.L.P.

[57] ABSTRACT

A method of controlling an electrophotographic imaging process wherein a two-component developer is mixed and activated to obtain a uniform distribution and triboelectric charging of the toner, by interruption of the process and carrying out extra activation and mixing cycles as a function of image area coverage and/or distribution of the image over the image field.

10 Claims, 1 Drawing Sheet

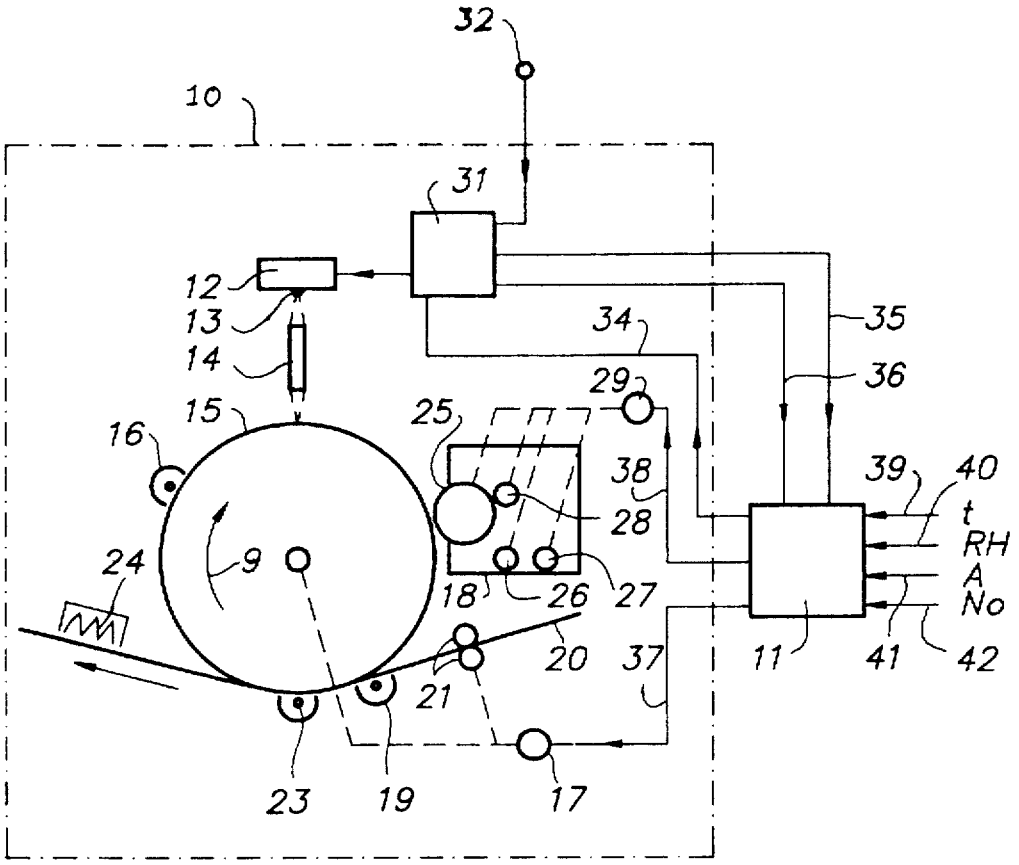
32
10
31
12
13
14
15
16
24
9
25
28
18
26
27
29
34
35
36
38
39
40
t
RH
A
No
11
41
42
20
37
21
23
19
17

METHOD OF CONTROLLING AN ELECTROPHOTOGRAPHIC IMAGING PROCESS

DESCRIPTION

This application claim the benefit of U.S. Provisional Application No. 60/009,573 filed Jan. 3, 1996.

1. Field of the Invention

The present invention relates to electrophotographic process control, and more in particular to a method of controlling an electrophotographic imaging process with a view to produce images with a large image area coverage.

2. Description of the Art

In electrostatic latent image development it is known to transport the developing material, called the "developer" hereinafter, which is supported in the form of a magnetic brush on the outer peripheral surface of a magnet roller so as to develop an electrostatic image formed on an electrostatic latent image support member by causing the developer to contact the surface of said support member at a developing area where magnet roller and electrostatic latent image support member confront each other.

The developer is supplied to the rear side of the magnet roller in connection with the developing area thereof, and at the time of supplying it is required that the developer (composed of a mixture of carrier and toner) has been fully mixed and stirred, with toner particles therein being sufficiently triboelectrically charged, and sufficiently uniformly distributed along the length of the sleeve.

In order to satisfactorily mix and stir the developing material, it is known to use neighbouring feeding passages running parallel to the magnet roller, through which the developer is fed in opposed directions by means of helical feed screws disposed in each feeding passage, thereby to circulate the developing material through end openings in a partition wall which separates the feeding passages. Between the screw feed circulation system and the magnet roller there is a buffer of developer. Suchlike arrangement is disclosed e.g. in U.S. Pat. No. 5,142,333 assigned to the present assignee.

In the operation of the developing device, the magnet roller is consuming developer out of the buffer and returning depleted developer thereto. The screw feeders are circulating the developer, and are mixing and charging toner which is added to compensate for toner depletion by the charge image.

In the described prior art developing device, and also in all other similar devices, a large number of successive prints with high image content leads to image quality degradation due to poor charging of the large amounts of freshly added toner resulting in toner dust cloud generation, fog, poor image resolution, bad image transfer to the receptor material, etc., and to large toner concentration gradients over the length of the magnet roller resulting in poor image density uniformity, toner dust generation, fog, poor image resolution, bad image transfer to the receptor material, etc.

SUMMARY OF THE INVENTION

Object of the invention

It is the object of the invention to provide an electrophotographic imaging process that allows to obtain an improved image quality, in particular with respect to density uniformity, that generates less toner dust and that also allows development of more severe image contents, e.g. up to 100% area coverage, or extreme left to right differences in image coverage.

Statement of the invention

In accordance with the present invention, a method of controlling an electrophotographic process wherein a two-component (carrier and toner particles) developer is mixed and activated to obtain a uniform distribution and triboelectric charging of the toner, by interrupting the process and carrying out extra developer activation and mixing cycles, is characterised in that such control occurs on the basis of the image area coverage.

The interruption of the electrophotographic process preferably occurs before the developing results are going to become unsatisfactory as a consequence of differences in developer concentration and/or triboelectric charging.

The present invention includes also a method of controlling an electrophotographic imaging process wherein a two-component (carrier and toner particles) developer is mixed and activated to obtain a uniform distribution and triboelectric charging of the toner, by interrupting the process and carrying out extra developer activation and mixing cycles, which is characterised in that such control occurs on the basis of the distribution of the image over the image field.

Further, the invention includes also a method of controlling an electrophotographic imaging process wherein a two-component (carrier and toner particles) developer is mixed and activated to obtain a uniform distribution and triboelectric charging of the toner, by interrupting the process and carrying out extra developer activation and mixing cycles, wherein said control occurs on the basis of imag area coverage, as well as on the basis of the distribution of the image over the image field.

The assessing of the moment of interruption of the process can additionally occur on the basis of other parameters such as age of the developer and number of prints made, relative humidity, temperature, etc., The assessing of image coverage and of image distribution can be made on the basis of the electric image signal that controls the exposure means, e.g. a scanning laser beam or a LED-array, which is used to image-wise expose a uniformly electrostatically charged photoconductor drum in order to obtain the desired electrostatic charge image.

JP 61 158 354 and 61 158 355 both disclose a system wherein the imaging process is temporarily interrupted and meanwhile extra developer activation and mixing are carried out. The first document teaches to base such interruption on a concentration difference between an end and the centre part of the developing unit, whereas the second one bases such interruption on a temperature difference measurement.

BRIEF DESCRIPTION OF THE DRAWING

The invention will be described hereinafter by way of example with reference to the accompanying drawing which shows one embodiment of an arrangement for carrying out the inventive process.

DETAILED DESCRIPTION OF THE INVENTION

In the accompanying figure, block 10 diagrammatically shows a LED (light emitting diode) printer, whereas block 11 is a controller for controlling the imaging process in accordance with the present invention.

The printer comprises an exposure head 12 provided with a line-like array of energizable pointlike radiation emitters 13 in the form of LED's and with electronic circuity for controlling the operation of the LED's, and optical transfer means 14 such as a Selfoc (Registered Trade name) for transferring the images of the emitters on a photoconductor coated on the cylindrical surface of a drum 15. The operation of the printer is as follows.

A corona charge station 16 electrically charges the surface of drum 15, the sense of rotation of the drum being indicated by arrow 9 and the driving of the drum occurring by means of motor 17. The electrostatic charge pattern produced on the drum by the line-wise exposure by exposure head 12 is developed by a developing station 18 which brings a two-component developer in contact with the drum and causes toner deposition on the charged areas of the drum.

A corona transfer station 19 transfers the toner image from the drum surface onto a paper sheet 20 that is conveyed in contact with the drum and advanced by driving means shown by roller pair 21. The paper driving means is coupled to the drum driving means so that synchronous motion of paper and drum is obtained.

A corona separating station 23 ensures the separation of the paper sheet from the drum. A fuser station 24 fuses the toner image on the sheet so that a permanent copy is obtained.

Developing station 18 comprises a magnet roller 25 and helical feed screws such as 26, 27 and 28 running parallel to the magnet roller for mixing and agitating the developer mixture in the station to obtain a uniform distribution of toner and carrier, and also to sufficiently and uniformly triboelectrically charge the toner by the action of stirring and mixing. The different rollers of the developing device are driven by a motor 29. A first reason for mixing and agitating the developer is the addition of fresh toner to the developer in order to compensate for depletion thereof caused by the development of the charge image. A second reason for mixing and agitation of the developer is the loss of triboelectric charge and of uniform toner distribution caused by the development process, even if toner concentration is allright. The present invention is concerned with both reasons, and the control of the process to obtain improved results is as follows.

Controller 11 controls electronic circuit 31 in the path of the image signal from input 32 to exposure head 12 which has the following functions. First, circuit 31 can operate as a switch to interrupt the signal transfer to the exposure head thereby to stop the exposure. This switching is controlled by a signal on line 34. Secondly, circuit 31 is arranged for calculating the area coverage of the image to be printed as well as the image distribution thereof. The expression "image distribution" means in the present context the differences in image content from left to right, i.e. in a direction running parallel to the magnet roller. The area coverage signal is fed to controller 11 over line 35, whereas the image distribution is fed over line 36.

Further, controller 11 also controls the operation of driving motors 17 and 29 over lines 37 and 38.

Apart from the information on inputs 35 and 36, controller 11 can also be responsive to the temperature (t) of the developer via line 39, the relative humidity of the air (RH) via line 40, the age (A) of the developer via line 41, and the number (No) of prints produced already by the developer via line 42.

In order to allow proper operation of the process, the developing station and the developing process are completely characterized in that the image quality (e.g. image density uniformity) is measured over the image surface (viz. page) as a function of all relevant parameters, viz. image area coverage (i.e. toner throughput), image distribution, relative humidity, temperature of the developer, age of the developer, and number of prints made already.

Also the amount of extra mixing and extra activation of the developer in the developing station is determined which is required to re-adjust the image quality within the desired specifications.

Based on this assessing of image evolution, two models are built, one model predicting when the developing unit and the developer will fail based on measurements of relative humidity and temperature, area coverage (e.g. determined by cumulative bit image count of the output of a raster image processor), developer age and the number of prints, and the other one predicting the amount of activation (i.e. extra rotation of the rollers of the developing device without making images) needed to re-adjust toner charge level, toner charge distribution and toner concentration gradient. These models are used to control the operation of controller 11.

During image processing, process controller 11 will keep track of relative humidity, temperature, cumulative bit count number of prints, and developer age. Every time that image quality is predicted to be out of specification of model one, driving means 17 and printing circuity 31 are stopped to interrupt the printing process whereas driving means 29 continues to operate to cause the feed screws and/or other agitation members of developing drive 18 to make extra rotations in order to perform extra activation of the developer. The magnitude of this extra activation, in practice the number of revolutions of the feed screws, is determined by model two of controller 11.

It will be understood that the interruption of imaging will not occur instantly as controller 11 signals the need for extra activation of the developer since this would mean the loss of the image which is being developed at that time. Thus, image-wise exposure and developing will continue until the image in progress has been finished.

The process described hereinbefore is capable of producing an unlimited number of images with large image coverage without suffering from left/right differences in toner concentration or differences in developer activation leading to unsatisfactory image quality.

The inventive process offers the great advantage that a given electrophotographic printer need not be designed for a particularly high image area coverage (even up to 100%), since such design would lead to an expensive and complicated construction of the developing device. On the contrary, a device for carrying out the method according to the present invention may have been basically designed for a quite usual image coverage, e.g. up to 30 a 40%, and yet be perfectly suited for extraordinary coverage if controlled in accordance with the present invention. Or in other words, it is the image covering itself that will cause the activation and mixing of the developer to exceed pre-established limits.

The invention is not limited to the embodiment described hereinbefore.

It is clear that the developing station will also comprise a toner addition system operating to keep toner concentration of the developer at the desired level. Such toner concentration control can be based on the distinct parameters controlling the process controller described hereinbefore, but can also be monitored autonomously by a conventional toner concentration sensor.

The image-wise exposure can also occur by a scanning laser beam, by light-valves, etc. instead of by LED's.

In the case of colour printing comprising e.g. four distinct imaging stations, the station in which first inadequate developing quality is signalled may control the stopping of the other stations until satisfactory developing conditions have been re-established.

We claim:

1. A method for controlling an electrophotographic imaging process in which at least a two-component developer, including carrier and toner particles, is mixed in a mixing step to obtain a uniform distribution and triboelectric charging of the toner particles, and the at least two-component developer is used in a developing step to develop an image, the method comprising the steps of:

calculating the image area coverage of an image to be developed; and interrupting the developing step based, at least in part, on the calculated image area coverage, while proceeding with the mixing step of the at least two-component developer to achieve a uniform distribution of the carrier and toner particles and a uniform and sufficient level of charging of the toner particles.

2. The method of claim 1, wherein the step of interrupting the developing step is further based on the relative humidity and temperature of the environment, age of the developer, and the number of prints produced by the process.

3. The method of claim 1, further comprising a developing unit containing the developer, and wherein the step of interrupting the developing step is further based on a model of the developer and of the developing unit, which model predicts unsatisfactory developing results as a function of the image area coverage.

4. The method of claim 1, further comprising a developing unit containing the developer, and wherein the step of interrupting the developing step is further based on a model of the developer and of the developing unit, which model predicts the amount of developer mixing needed to readjust the process.

5. The method of claim 1, wherein the step of interrupting the developing step occurs only after an image has been completely developed.

6. A method for controlling an electrophotographic imaging process in which at least a two-component developer, including carrier and toner particles, is mixed in a mixing step to obtain a uniform distribution and triboelectric charging of the toner particles, and the at least two-component developer is used in a developing step to develop an image, the method comprising the steps of:

calculating the image distribution of at least a portion of an image to be developed; and interrupting the developing step based, at least in part, on the calculated image distribution, while proceeding with the mixing step of the at least two-component developer to achieve a uniform distribution of the carrier and toner particles and a uniform and sufficient level of charging of the toner particles.

7. The method of claim 6, wherein the step of interrupting the developing step is further based on the relative humidity and temperature of the environment, age of the developer, and the number of prints produced by the process.

8. The method of claim 6, further comprising a developing unit containing the developer, and wherein the step of interrupting the developing step is further based on a model of the developer and of the developing unit, which model predicts unsatisfactory developing results as a function of the image area coverage.

9. The method of claim 6, further comprising a developing unit containing the developer, and wherein the step of interrupting the developing step is further based on a model of the developer and of the developing unit, which model predicts the amount of developer mixing and activating needed to readjust the process.

10. The method of claim 6, wherein the step of interrupting the developing step occurs only after an image has been completely developed.

* * * * *